US007642477B2

(12) United States Patent
Peng et al.

(10) Patent No.: US 7,642,477 B2
(45) Date of Patent: Jan. 5, 2010

(54) BUTTON FIXING MECHANISM

(75) Inventors: Xiong-Dong Peng, Shenzhen (CN); Zhi-Gang Chen, Shenzhen (CN); Jie Zhang, Shenzhen (CN); Zheng Shi, Shenzhen (CN); Ke-Cheng Lin, Tu-Cheng (TW); Chien-Li Tsai, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 374 days.

(21) Appl. No.: 11/354,778

(22) Filed: Feb. 15, 2006

(65) Prior Publication Data

US 2007/0017791 A1 Jan. 25, 2007

(30) Foreign Application Priority Data

Jul. 22, 2005 (CN) ..... 2005 2 0061955 U

(51) Int. Cl.
*H01H 13/00* (2006.01)
*H01H 3/00* (2006.01)

(52) U.S. Cl. ..... 200/339; 200/296

(58) Field of Classification Search ..... 200/339
See application file for complete search history.

(56) References Cited

U.S. PATENT DOCUMENTS

| | | | | |
|---|---|---|---|---|
| 3,598,950 | A * | 8/1971 | Ohashi | 200/315 |
| 5,612,520 | A | 3/1997 | Toedtman et al. | |
| 6,956,179 | B2 * | 10/2005 | Gillman et al. | 200/302.3 |
| 7,026,564 | B1 * | 4/2006 | Savicki et al. | 200/339 |
| 7,122,752 | B2 * | 10/2006 | Nagai et al. | 200/315 |
| 2007/0246340 | A1 * | 10/2007 | Zhao et al. | 200/339 |

* cited by examiner

*Primary Examiner*—Michael A Friedhofer
*Assistant Examiner*—Lheiren Mae A Anglo
(74) *Attorney, Agent, or Firm*—Zhigang Ma

(57) ABSTRACT

A button fixing mechanism for fixing a button (50) to a base (20) of an electronic device includes a top panel (30) of the base, a shelf (40) attached to the top panel, and a pair of resilient members (60). The button includes a pair of shafts (53) extending outwardly from sidewalls (51) thereof. The shelf includes an oblong slot (42) defined therein, and a pair of tabs (422) extending beside the oblong slot and each defining a pivoting hole (423) therein. The button is extended through the oblong slot, with the shafts received in the pivoting holes of tabs. The resilient members are separately attached to the top panel and engage two ends of the button.

18 Claims, 6 Drawing Sheets

BUTTON FIXING MECHANISM

BACKGROUND OF THE INVENTION

1. Field of the Invention

The present invention relates to a fixing mechanism, and more particularly to a fixing mechanism to fix a button to a base of an electronic device.

2. General Background

Electronic devices, such as notebook computers, laptop computers, PDAs, are widely used. A notebook computer typically includes a plurality of function buttons for facilitating activating corresponding functions. For example, a suspend button is typically attached to a base of the notebook computer by a resilient strip, for being pressed by a foldable cover of the notebook computer to enter suspend mode when the cover is folded toward the base. The suspend button is typically fixed at a free end of the strip. Another end of the strip opposite to the free end is fixed to the base. However, the button actuates one switch of a circuit. A plurality of buttons is arranged in the base of the notebook computer to completed functions. A top of the base of the notebooks appears in mess. Additionally, more space of the top of the base is occupied by the buttons.

What is desired, therefore, is a button fixing mechanism which can selectively actuate buttons.

SUMMARY

In one preferred embodiment, a button fixing mechanism for fixing a button to a base of an electronic device includes a top panel of the base, a shelf attached to the top panel, and a pair of resilient members. The button includes a pair of shafts extending outwardly from sidewalls thereof. The shelf includes an oblong slot defined therein, and a pair of tabs each defining a pivoting hole. The button is extended through the oblong slot, with the shafts received in the pivoting holes of tabs. The resilient members are attached to the top panel and separately engage the button.

Other advantages and novel features will become more apparent from the following detailed description of a preferred embodiment when taken in conjunction with the accompanying drawings, in which:

DETAILED DESCRIPTION OF THE EMBODIMENTS

Figure 1:
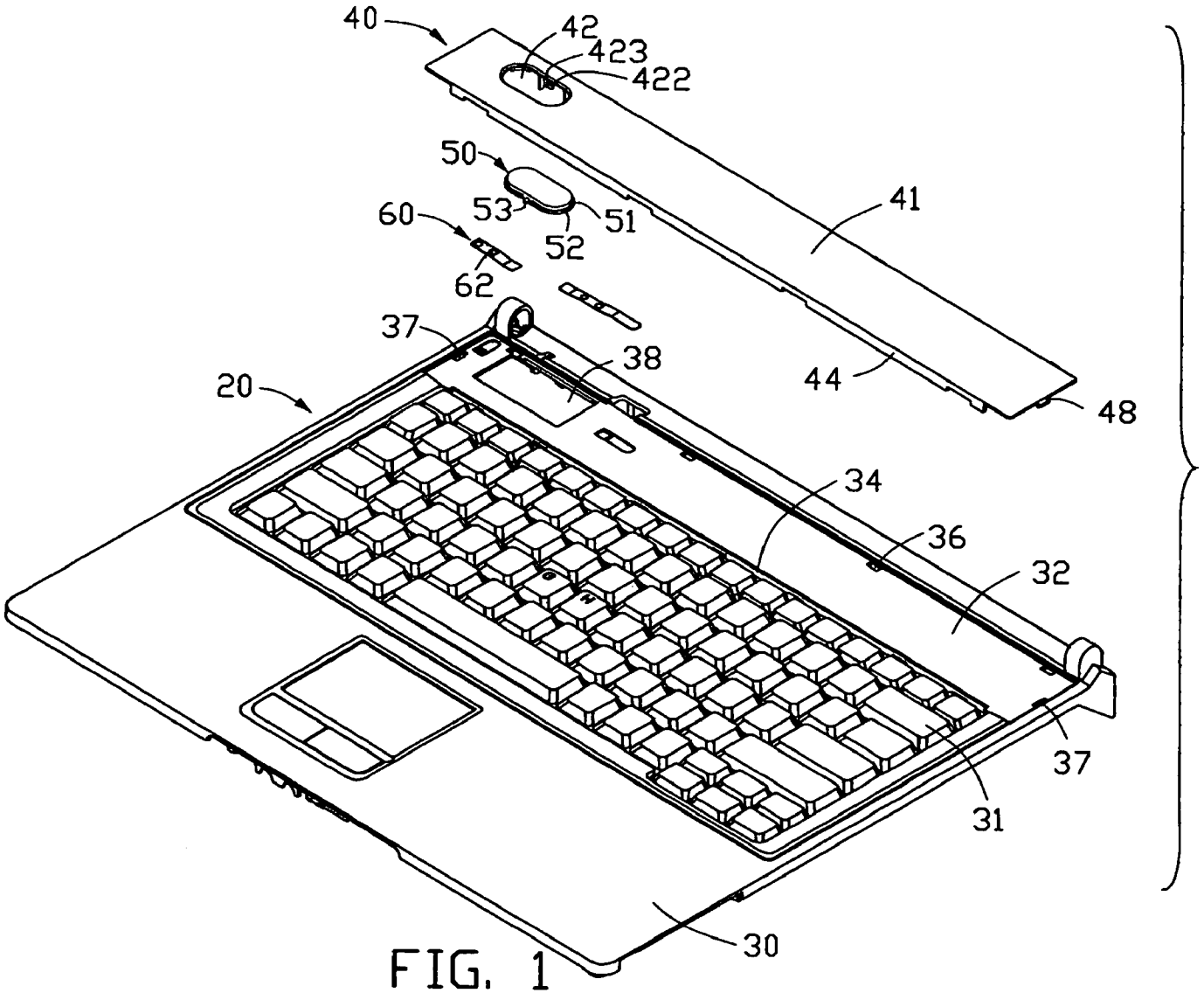
FIGS. 1 and 2 are exploded, isometric views of a button fixing mechanism in accordance with a first preferred embodiment of the present invention.
Figure 2:
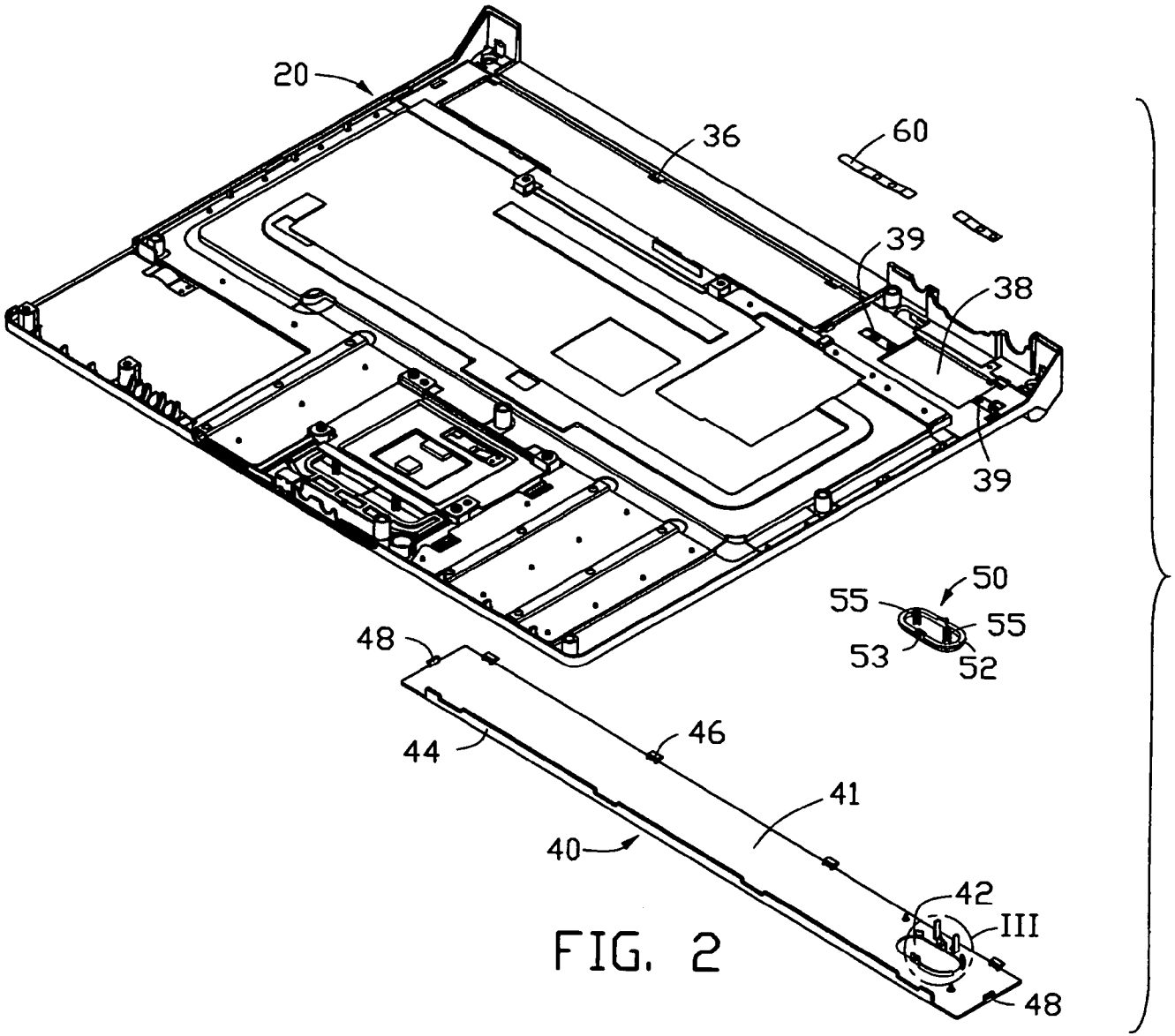

Referring to FIGS. 1 and 2, a button fixing mechanism is provided to fix a trigger component like a button 50 to a base 20 of an electronic device like a notebook computer, the button fixing mechanism in according a first embodiment of the present invention including a top panel 30 of the base 10, a shelf 40 attached to the top panel 30 for commonly defining a user-accessible surface, and a pair of resilient members 60.

Figure 5:
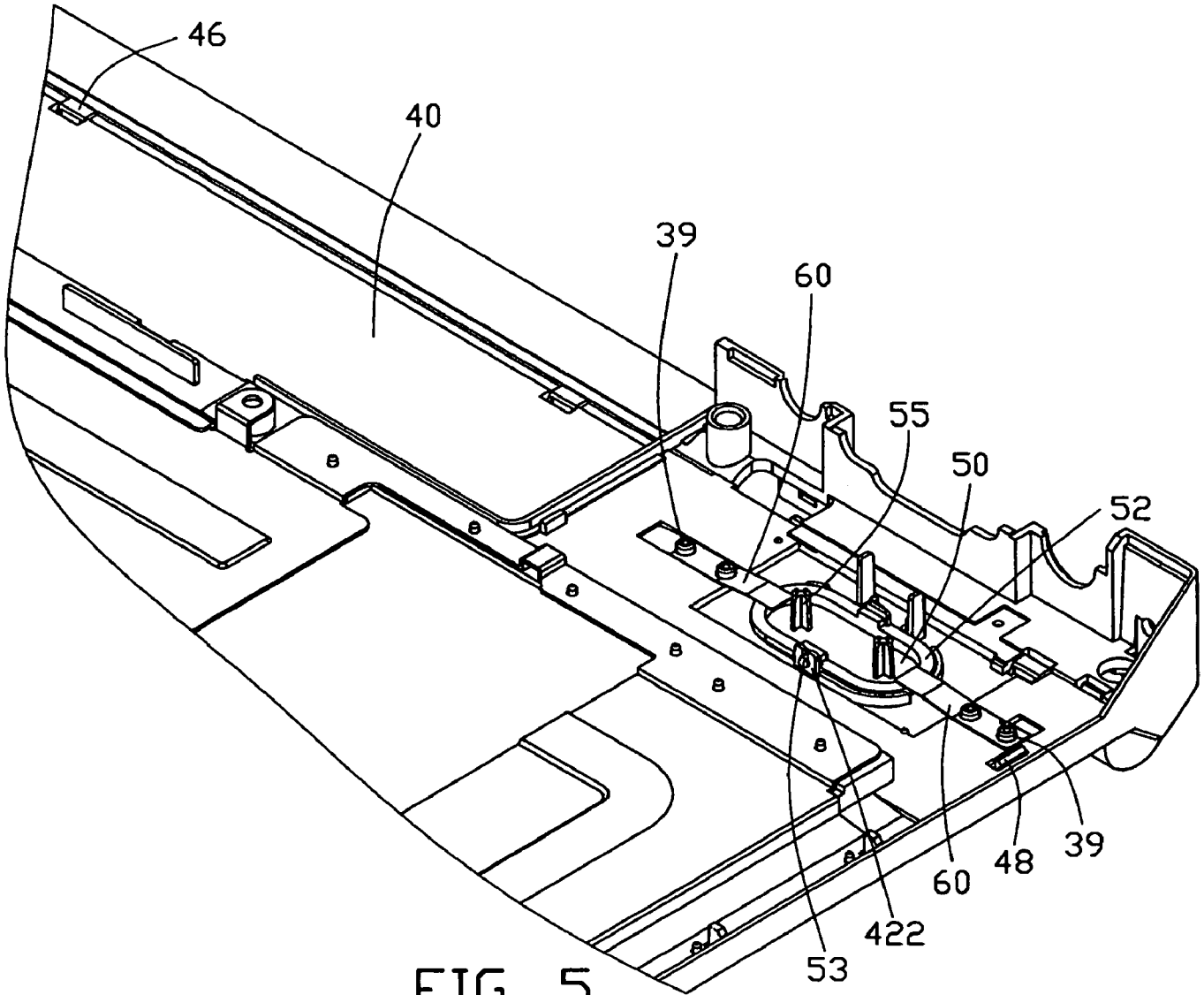
FIG. 5 is a partial assembled view of the button fixing mechanism of FIG. 2.

Referring also to FIG. 5, the top panel 30 is formed on a top of the base 20 and includes a keyboard 31 attached thereon, and a recess 32 defined in a rear portion of the top panel 30 behind the keyboard 31. A longwise groove 34 is defined in a front edge portion of the recess 32 beside the keyboard 31. A plurality of locking slits 36, 37 is defined in other edge portions of the recess 32. A rectangular slot 38 is defined in a left end portion of the recess 32. Two pairs of pins 39 separately depend from a lower portion of the top panel 30 beside two opposite ends of the rectangular slot 38, for attaching the resilient members 60 thereon. In the first preferred embodiment, the resilient members 60 are resilient tabs. A pair of fixing apertures 62 is defined in each of the resilient members 60.

Figure 3:
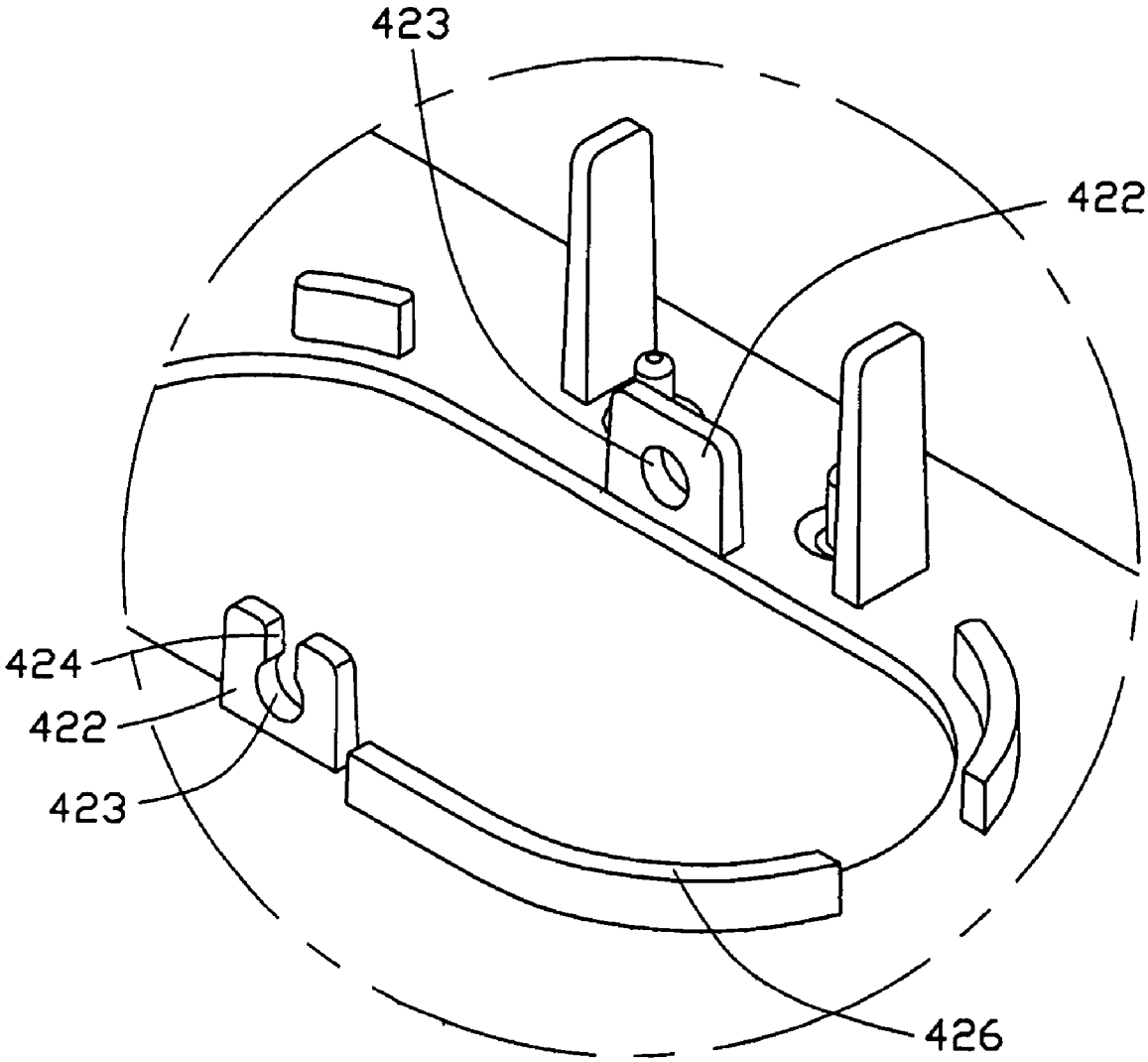
FIG. 3 is an enlarged view of a circled portion III of FIG. 2.

Referring also to FIG. 3, the shelf 40 includes a main plate 41, and a flange 44 depending from a longwise edge of the main plate 41. A plurality of hooks 46, 48 extends from other edges of the main plate 41, engaging in the locking slits 36, 37 of the top panel 30. An oblong slot 42 is defined in a left end portion of the shelf 40, corresponding to the rectangular slot 38 of the top panel 30. A pair of tabs 422 depends from a lower portion of the shelf 40 beside the oblong slot 42. A pivoting hole 423 is defined in each of the tabs 422. A notch 424 is defined in one of the tabs 422 and communicates the corresponding pivoting hole 423. A plurality of surround walls 426 depends from the lower portion of the shelf 40 around the oblong slot 42.

The button 50 is disposed into the oblong slot 42 of the shelf 40. The button 50 includes a pair of shafts 53 extending from sidewalls 51 thereof, rotatably received in the pivoting holes 423 of the shelf 40. The shafts 53 align in a line. A skirt 52 horizontally extends from a distal of the sidewalls 51 of the button 50. The button 50 also includes a pair of posts 55 extending from a lower portion thereof, each for actuating a switch of a corresponding control circuit so as to trigger one function of the computer. The posts 55 separately locate at two ends of the button 50.

Figure 4:
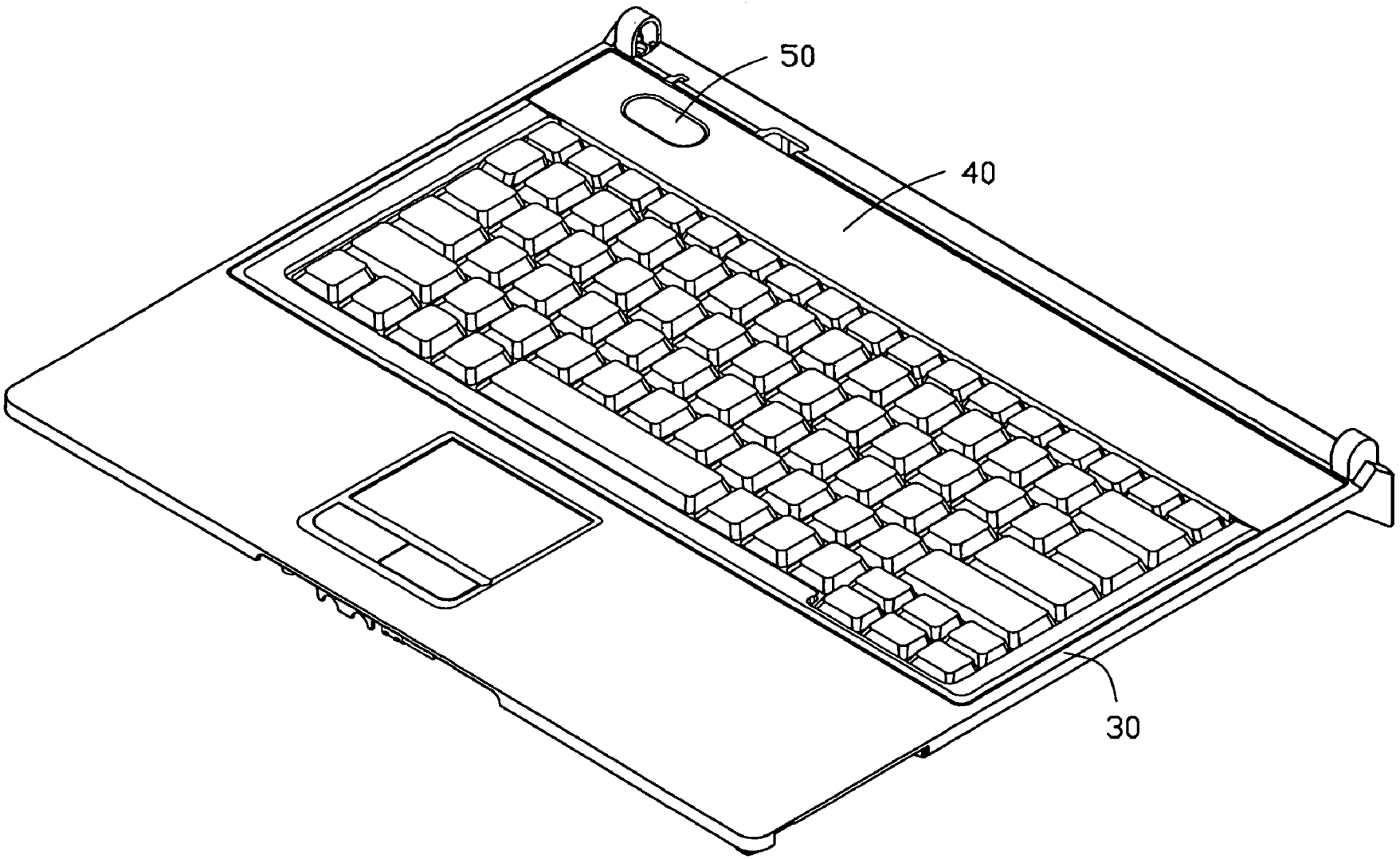
FIG. 4 is an assembled view of the button fixing mechanism of FIG. 1.

Referring also to FIGS. 4-5, in assembly, the button 50 is inserted into the oblong slot 42 of the shelf 40, with the shafts 53 receiving in the pivoting holes 423 via the notch 424 and the skirt 52 engaging the surrounding walls 426. The shelf 40 is attached to the top panel 30 and covers the recess 32, with the flange 44 and the hooks 46, 48 engaging in the corresponding groove 34 and the locking slits 36, 37. The resilient members 60 are attached to the top panel 30, with the pins 39 engaging in the fixing apertures 62.

In use, two ends of the button 50 can be selectively pressed downwardly by applying a force thereon. Thus the button 50 rotates about the shafts 53, the corresponding post 55 contacting and activating the corresponding switch of control circuit and the corresponding resilient member 60 deforming. When the force is released, the corresponding resilient member 60 rebounds to move the button 50 back.

Figure 6:
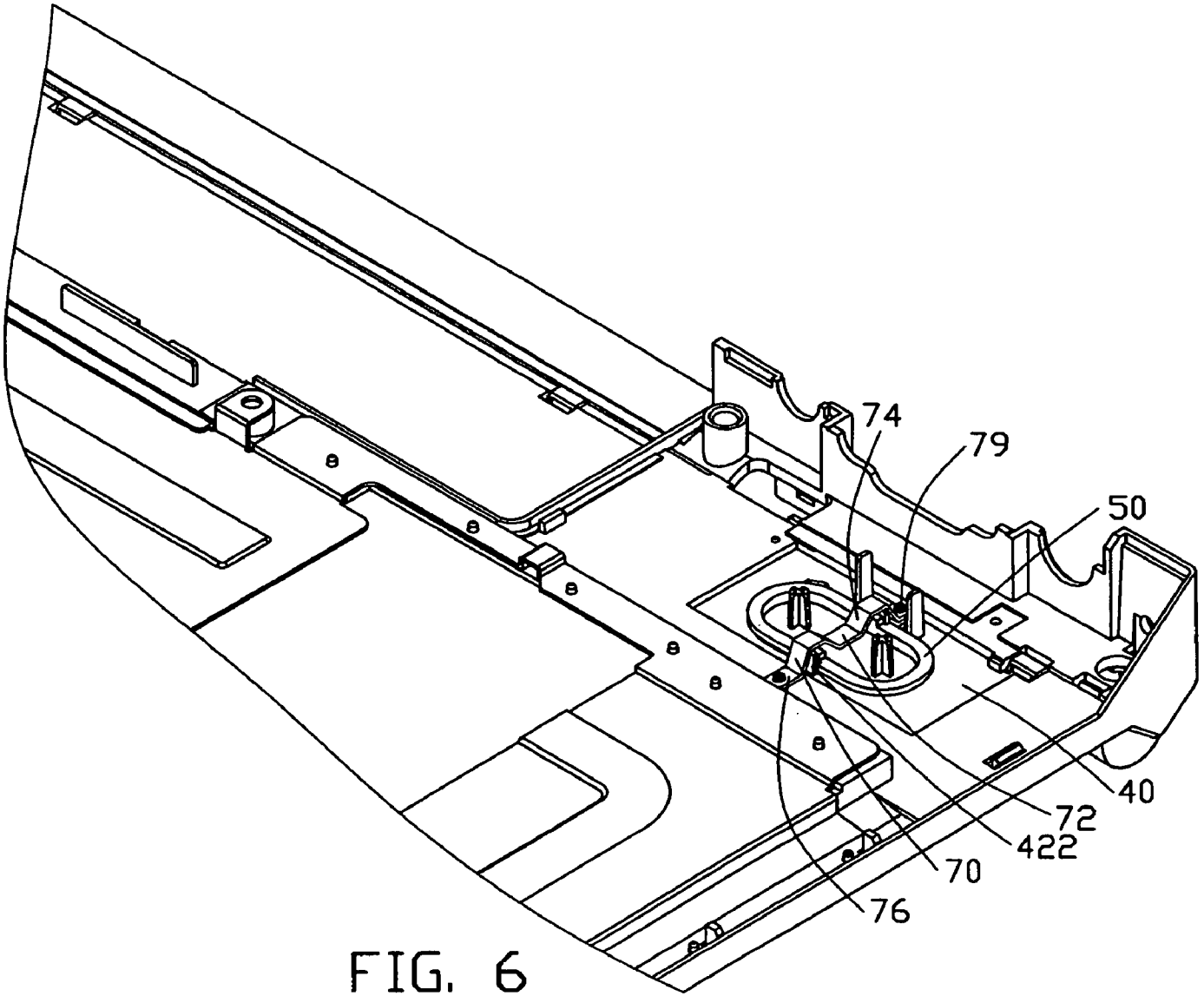
FIG. 6 is an assembled view of a button fixing mechanism in accordance with a second preferred embodiment of the present invention.

Referring to FIG. 6, in the second preferred embodiment, the resilient members 60 can be replaced by an integrated strip 70. The strip 70 is generally M-shaped, and includes a base portion 72 contacting the lower portion of the button 50, a pair of fixing portions 76, and a pair of connecting portions 74 formed between the base portion 72 and the fixing portions 76. The fixing portions 76 are fixed to the lower portion of the top panel 30 beside the tabs 422 via conventional fasteners 79.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. A button fixing mechanism comprising:

a base of an electronic device comprising a top panel;

a shelf attached to the top panel, the shelf comprising a slot defined therein, and a pair of tabs each defining a pivoting hole therein, wherein one of the tabs of the shelf further comprises a notch defined therein and communicating with the corresponding pivoting hole;

a button received in the slot, wherein the button comprises a pair of shafts extending from two opposite sidewalls thereof and engaging in the pivoting holes; and a pair of resilient members attached to the top panel and engaging with two opposite ends of the button.

2. The button fixing mechanism as claimed in claim 1, wherein the shafts align in a line.

3. The button fixing mechanism as claimed in claim 1, wherein the top panel comprises a recess, the shelf covers the recess.

4. The button fixing mechanism as claimed in claim 3, wherein the recess defines a rectangular slot, corresponding to the slot of the shelf, the resilient members are a pair of resilient tabs, one end of each of the resilient members is fixed to the top panel adjacent an end of the rectangular slot.

5. The button fixing mechanism as claimed in claim 3, wherein the recess defines a longwise groove along a side thereof, a flange depends from the shelf to engage in the groove.

6. The button fixing mechanism as claimed in claim 5, wherein the recess defines a plurality of fixing slits therein, the shelf comprises a plurality of hooks engaging in the fixing slits.

7. The button fixing mechanism as claimed in claim 6, wherein the shelf comprises a plurality of surrounding walls depends around the slot thereof, the button comprises a skirt extending from a bottom of the sidewalls thereof to engage with the surrounding walls.

8. The button fixing mechanism as claimed in claim 1, wherein the button further comprises a pair of posts disposed at two opposite ends thereof to actuate switches.

9. A button fixing mechanism comprising:

a base of an electronic device comprising a top panel and a shelf attached to the top panel, the shelf defining a first slot therein, wherein a pair of tabs depends from the shelf, each of the tabs define a pivoting hole therein;

two switches for triggering two different functions of the electronic device, the two switches disposed at the electronic device;

a button received in the first slot and comprising a pair of shafts pivotably received in the pivoting holes of the shelf and a pair of posts separately disposed besides the pair of shafts adapted to selectively contact and actuate the switches, wherein the pair of shafts extends in a way substantially perpendicular to the posts; and a resilient member attached to the base and engaging with the button to bias the button to disengage from the switches.

10. The button fixing mechanism as claimed in claim 9, wherein a recess is defined in the top panel, the shelf covers the recess.

11. The button fixing mechanism as claimed in claim 10, wherein the recess comprises a groove, and a plurality locking slits defined therein, the shelf comprises a flange, and a plurality of hooks separately engaging in the groove and the locking slits.

12. The button fixing mechanism as claimed in claim 9, wherein the top panel defines a second slot in the region of the recess, and corresponding to the first slot of the shelf, the resilient member is attached to the recess beside the second slot.

13. The button fixing mechanism as claimed in claim 12, wherein the resilient member is a pair of resilient tabs, the resilient tabs are respectively attached to the top panel beside two end of the first slot of the shelf.

14. An electronic device comprising:

a base of said electronic device defining an user-accessible surface thereon, wherein said user-accessible surface forms a recess region and defines a longwise groove along a side of the recess region, the base further comprises a shelf covering the recess region and a flange extending therefrom adapted to engage in the groove;

a button movably installable in said recessed region and partially extending through said shelf to be user-accessible, said button comprising a shaft engagable with said base so as to be swayable about said shaft between first and second positions thereof to trigger two respective ones of functions of said electronic device, and a third position thereof to trigger none of said functions, wherein the shaft is substantially parallel to said user-accessible surface of the base; and a resilient member installable in said base beside said button and engagable with said button so as to urge said button to move toward said third position thereof from a selective one of said first and second positions thereof.

15. The electronic device as claimed in claim 14, wherein said button comprises a pair of posts disposed at two opposite ends of said button and extending away from said user-accessible surface into said base for triggering.

16. The electronic device as claimed in claim 14, wherein said button further comprises a skirt extending from said button beside and along said user-accessible surface so as to be capable of controlling movement of said button relative to said user-accessible surface by engagement with said base.

17. The electronic device as claimed in claim 14, wherein the base comprises a pair of tabs each defining a pivoting hole for pivotably receiving portions of the shaft, one of the tabs further comprises a notch defined therein and communicating with the corresponding pivoting hole.

18. The button fixing mechanism as claimed in claim 14, wherein the recess region defines a plurality of fixing slits placed around periphery thereof, the shelf comprises a plurality of hooks adapted to engage in the fixing slits.

* * * * *

UNITED STATES PATENT AND TRADEMARK OFFICE

CERTIFICATE OF CORRECTION

PATENT NO. : 7,642,477 B2
APPLICATION NO. : 11/354778
DATED : January 5, 2010
INVENTOR(S) : Peng et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 698 days.

Signed and Sealed this

Sixteenth Day of November, 2010

David J. Kappos

David J. Kappos
*Director of the United States Patent and Trademark Office*